US006023224A

United States Patent [19]

Meyvis

[11] Patent Number: 6,023,224

[45] **Date of Patent: *Feb. 8, 2000**

[54] DOOR FRAME WITH INTEGRATED KEYLESS ENTRY SYSTEM

[75] Inventor: Daniel Vincent Meyvis, Bloomfield Hills, Mich.

[73] Assignee: The Stanley Works, New Britain, Conn.

[ * ] Notice: This patent is subject to a terminal disclaimer.

[21] Appl. No.: 08/902,249

[22] Filed: Jul. 29, 1997

[51] Int. Cl.[7] ..... G08B 13/08

[52] U.S. Cl. ..... 340/545; 49/25; 49/31; 315/153; 340/825.69

[58] Field of Search ..... 340/545, 825.69, 340/825.31, 572; 235/382; 49/31, 25; 315/153

[56] References Cited

U.S. PATENT DOCUMENTS

| | | | |
|---|---|---|---|
| 3,971,028 | 7/1976 | Funk | 340/825.69 |
| 4,054,008 | 10/1977 | Phillips | 49/31 |
| 4,141,010 | 2/1979 | Umpleby et al. | 340/825.69 |
| 4,163,218 | 7/1979 | Wu | 340/825.69 |
| 4,242,614 | 12/1980 | Vatis et al. | 315/153 |
| 4,355,309 | 10/1982 | Hughey et al. | 340/825.69 |
| 4,366,482 | 12/1982 | Remes et al. | 340/825.69 |
| 4,682,155 | 7/1987 | Shirley | 340/572 |
| 4,897,644 | 1/1990 | Hirano | 340/825.69 |
| 4,990,888 | 2/1991 | Vogt et al. | 340/545 |
| 5,097,454 | 3/1992 | Schwarz et al. | 49/31 |
| 5,142,152 | 8/1992 | Boiucaner | 49/25 |
| 5,325,084 | 6/1994 | Timm et al. | 340/825.31 |
| 5,541,585 | 7/1996 | Duhame et al. | 340/825.69 |
| 5,589,747 | 12/1996 | Utke | 49/25 |

*Primary Examiner*—Jeffery A. Hofsass
*Assistant Examiner*—John Tweel, Jr.
*Attorney, Agent, or Firm*—Young & Basile, P.C.

[57] ABSTRACT

An entry control and security system in the form of a pre-assembled door and door frame unit having an electric light, a motion detector, a radiant energy receiver and an electromechanically actuated latch all disposed on and built into the door frame. The invention provides an economically manufactured and easily installed unit which allows persons to unlatch a door by remote control in order to gain access to a building, as well as providing illumination in the vicinity of the doorway during periods of darkness. A radiant energy receiver, such as a radio frequency receiver, is disposed on the door frame and is electrically coupled with at least one electromechanical door latch also disposed on the frame. A keychain-sized remote control transmitter unit is carried by a person desiring access to the building. When a button on the remote control unit is pressed, the remote control unit transmits a coded signal which is received by the radiant energy receiver. If the signal bears the proper code, the latch is actuated to unlatch the door, allowing it to be pushed open with no further fumbling with keys, door knobs or manually actuated latches.

18 Claims, 4 Drawing Sheets

138
146
22
36
34
10
14
46
24
26
62
20
22
56
54
12
58
26
28
30
18
29
32
26
50
16

DOOR FRAME WITH INTEGRATED KEYLESS ENTRY SYSTEM

FIELD OF THE INVENTION

The present invention relates to a building security system which controls pedestrian access to a building through a door.

BACKGROUND OF THE INVENTION

Mechanical door locking mechanisms which utilize a conventional key to unlock a pedestrian door have been well known for many years. These mechanisms require a person to manually insert the key into the lock and turn the key to displace a bolt which, until displaced, prevents the door from being opened. This operation requires that the person locate the key, select the proper key for the particular lock, and unlock the door. The unlocking process requires one or both hands, requiring the person to set aside some or all of the items they may have been carrying. After the door is unlocked, the person must then turn the door knob to open the door. After opening the door, any items previously set aside must be retrieved. All of these activities take time to perform, causing the person seeking access to remain outside the door for an extended period of time. The additional time spent outside the door is especially disfavorable in high-crime areas or in adverse weather conditions such as rain, snow or extreme temperatures.

Remote control or "keyless" entry systems for pedestrian doors are also well known in the art. Some systems, instead of a conventional metal key, use hand-held electronic devices which transmit a signal to a receiver adjacent the door which decodes the signal and, if found to be from an authorized source, unlocks the door.

SUMMARY OF THE INVENTION

The present invention is an entry control and security system for a pedestrian doorway in the form of a pre-assembled door and door frame unit having an electric light, a motion detector, a radiant energy receiver and an electromechanically actuated latch all disposed on and built into the door frame. The invention provides an economically manufactured and easily installed unit which allows perdestrians to unlatch a door by remote control in order to gain access to a building, as well as providing illumination on the exterior of the doorway during periods of darkness.

In accordance with the present invention, a radiant energy receiver, such as a radio frequency receiver, is disposed on the door frame and is electrically coupled with at least one electromechanical door latch also disposed on the frame. A keychain-sized remote control transmitter unit is carried by a person desiring access to the building. When a button on the remote control unit is pressed, the remote control unit transmits a coded signal which is received by the radiant energy receiver. If the signal bears the proper code, the latch is actuated to unlatch the door, allowing it to be pushed open with no further fumbling with keys, door knobs or manually actuated latches.

A motion detector, such as a passive infrared detector, and an electric light are also disposed on the door frame. The motion detector senses a person or object in the vicinity of the door on the exterior side thereof and activates the light to provide illumination, thereby increasing the personal safety of a person about to pass through the door. The light also makes it easier for the person to locate and properly actuate the remote control transmitter unit carried by the person.

In the preferred embodiment of the invention, a photocell is also disposed on the door frame and electrically coupled with the light such that the light is only illuminated during periods of darkness.

In accordance with a further aspect of the invention, the electrical components of the system are connected to and receive power from the building electrical wiring system. This connection allows the entry control and security system to communicate with other electrical systems within the building by a line carrier system so as to permit the other systems to be switched on or off by actuation of the remote control unit.

In a preferred embodiment of the invention, an intercom and a video camera are also disposed on the door frame. This permits occupants of the building to view and/or communicate with persons desiring access to the building. A remote latch release is also provided within the building so that an occupant may unlatch the door after identifying the person desiring access.

In an alternative embodiment of the invention, the light, motion detector, photocell and radiant energy receiver are all disposed on and within a small module or visor that is mountable to a door frame on the exterior side thereof, preferably along the top of the frame on the lower surface of the head jamb. When connected with an electromechanical latch, the visor provides a quick and simple means to add the entry control and security features of the present invention to an existing door with a minimum amount of modification and without replacing the door frame.

DETAILED DESCRIPTION OF THE PREFERRED EMBODIMENT

Figure 1:
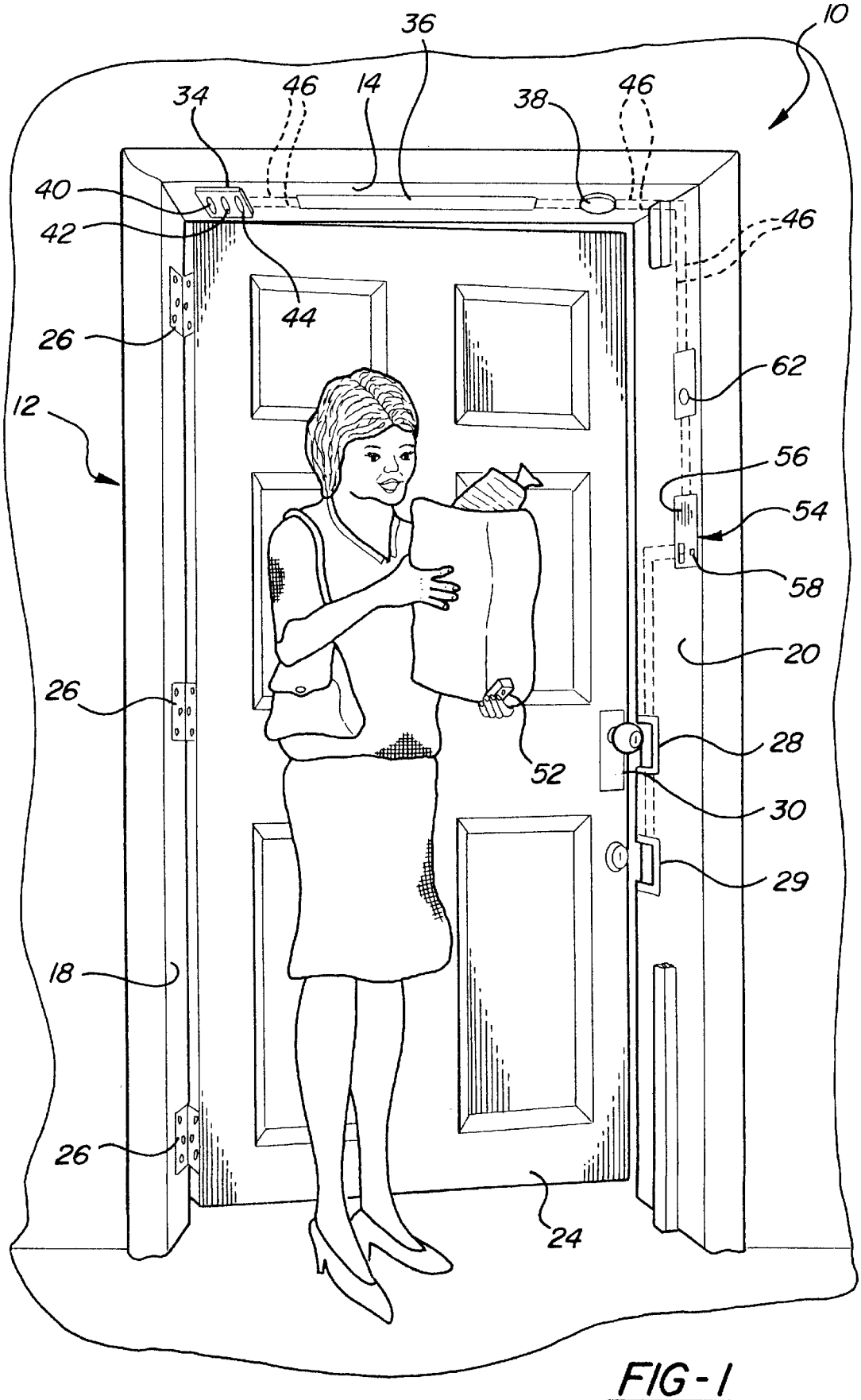
FIG. 1 is a perspective view of the invention.
Figure 2:
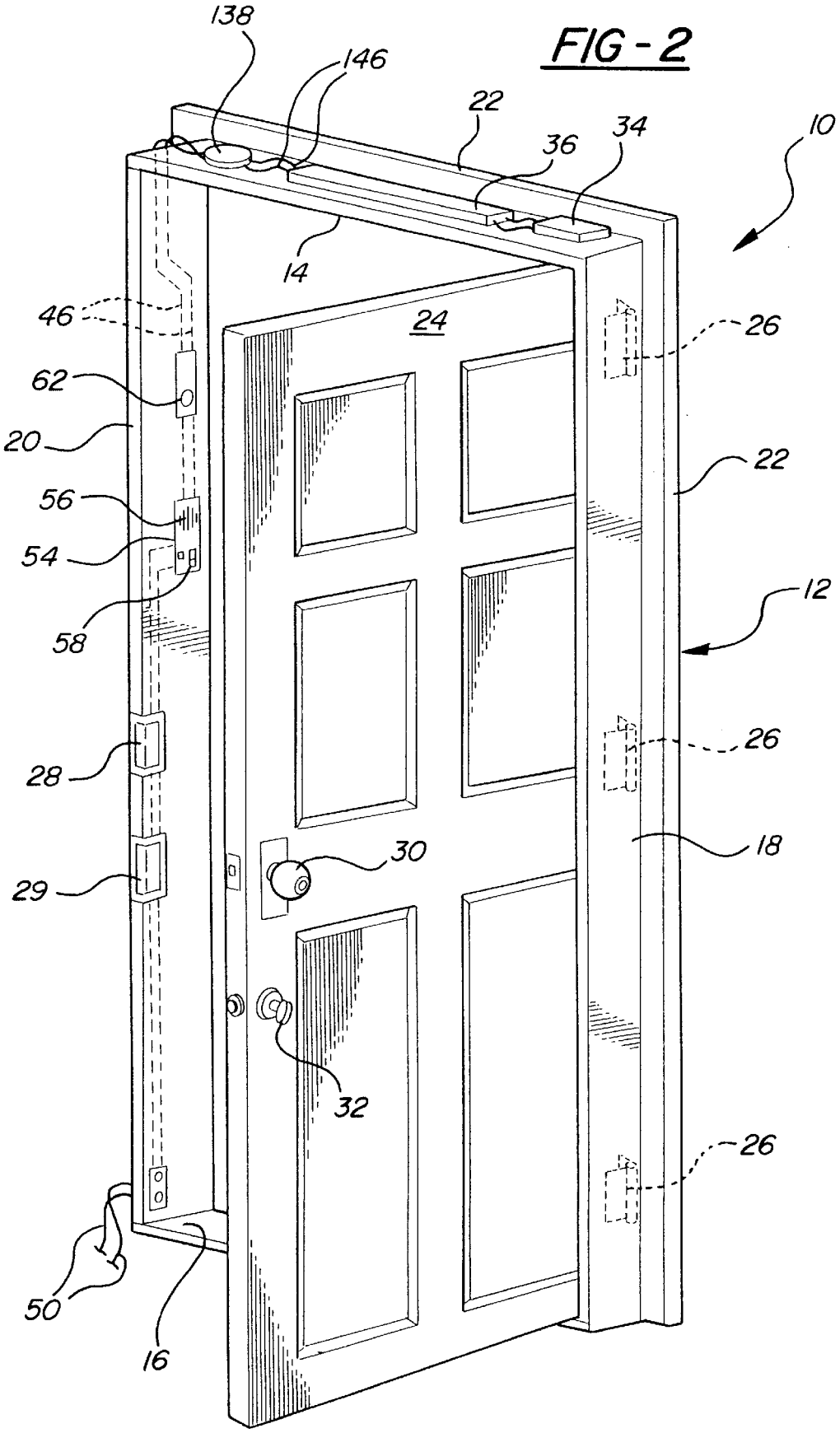
FIG. 2 shows the present invention installed in a conventional door opening.

Referring to FIGS. 1 and 2, a pre-hung door and door frame assembly 10 is shown. Assembly 10 comprises a door frame 12 including a head jamb 14, a threshold 16, a hinge jamb 18 and a latch jamb 20. A brick mold 22 extends around both sides and the top of the frame 12. A door 24 is mounted to the frame 12 by hinges 26 and is moveable with respect to the frame about a vertical hinge line. First and second electromechanical latches 28,29 are disposed on the hinge jamb 18 of the door frame 12 in vertical positions to correspond with a typical door knob latch mechanism 30 and a dead bolt mechanism 32 on the door 24.

A sensor and control module 34 is built into the head jamb 14 on the exterior side of the door 24 adjacent the hinge side of the frame 12. A low-intensity light 39, such as a low-voltage fluorescent light, is built into the head jamb 14 near the vertical centerline of the frame 12. A higher intensity courtesy light 38, such as a halogen lamp, is built into the head jamb 14 on the lock side of the frame 12.

Figure 3:
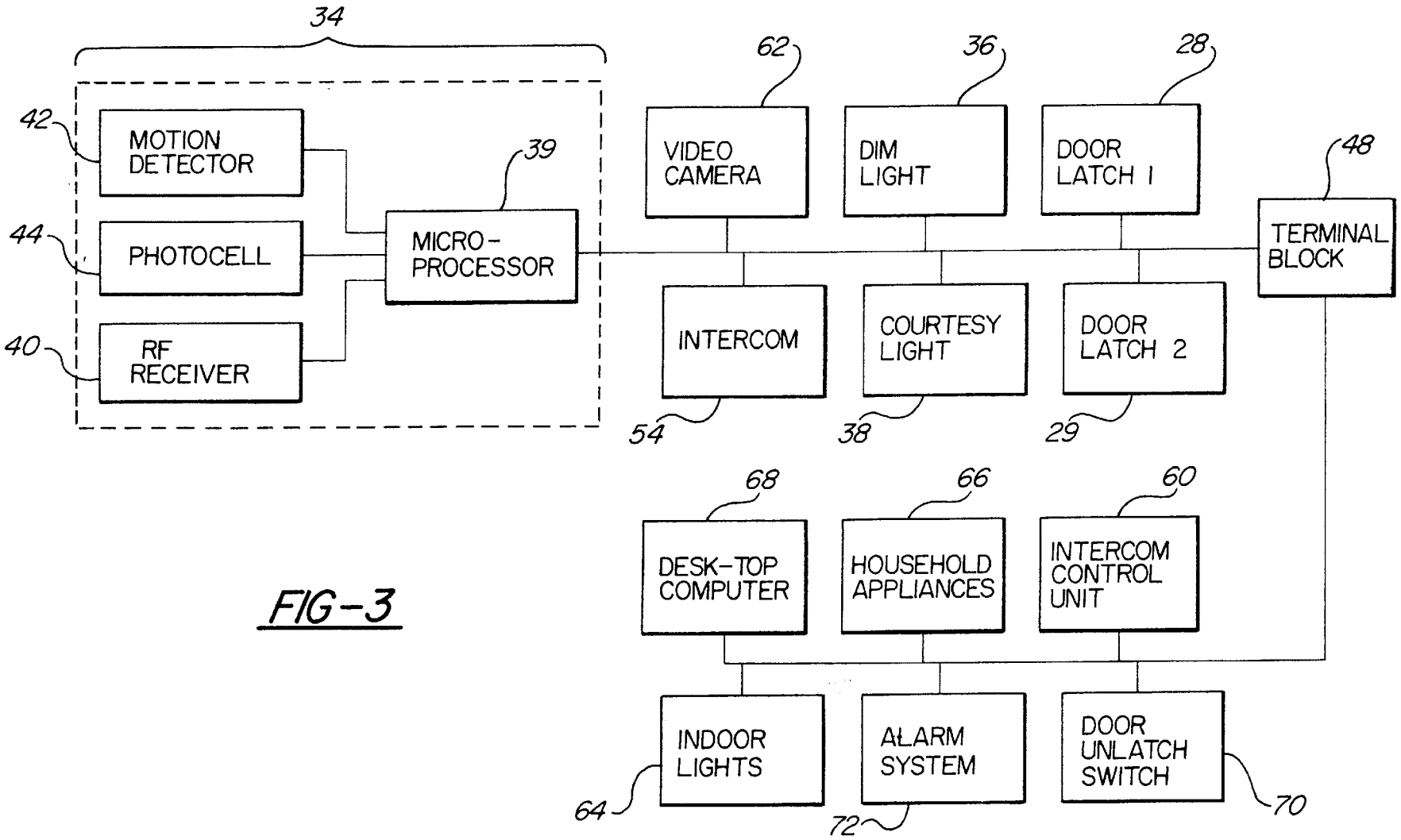
FIG. 3 is a block diagram showing the interconnection of the various components of the invention.

Sensor and control module 34 comprises a microprocessor 36 (see FIG. 3) for controlling the operation of the system, a radiant energy receiver 40, a motion detector 42, and a light detecting photocell 44. Radiant energy receiver 40 may, for example, be a radio frequency receiver or an infrared receiver 40. Motion detector 42 may, for example, be a passive infrared detector.

Electrical wires 46 extend between the sensor and control module 34, the low-intensity light 36, the courtesy light 38 and both of the electromechanical latches 28,29 to provide power to and communication between the components. The wires 46 extend further down the hinge jamb 18 to a terminal block 48 at the lower end of the hinge jamb. Low voltage electricity is supplied to the frame assembly 10 from the building electrical wiring system by power supply wires 50 which are connected to the terminal block 48. It is preferable to utilize low voltage electricity than the normal 120 volt used in building electrical systems in order to decrease the electrocution hazard in the event of a short in the electrical wiring.

As best seen in FIG. 2, the low-intensity light 36 and the courtesy light 38 are exposed on the lower side of the head jamb 14 so that they may cast their illumination into the exterior side of the doorway. The low-intensity light 36 provides a relatively dim and diffused illumination during all periods of darkness, as determined by the photocell 44 on the sensor and control module 34. The courtesy light 38 provides a more intense level of illumination and is switched on only when the motion detector 42 is triggered by movement within its field of view, or when the radiant energy receiver 40 is activated to unlatch the door 24, as described in greater detail hereinbelow.

A small, wireless remote control unit 52 is carried by a user (see FIG. 2). The remote control unit 52 transmits a signal of a type compatible with the radiant energy receiver 40. In the preferred embodiment, the remote control unit 52 and radiant energy receiver 40 operate in the radio frequency band and utilize a pulse-modulation coding technique, as disclosed in U.S. Pat. No. 4,141,040. The remote control unit 52 and receiver 40 preferably make use of a "rolling code" technology, as is well known in the art, to all but eliminate the possibility of the receiver being activated by any transmission other than that of its companion remote control unit.

An intercom 54 is mounted to the door frame 12 and is connected with sensor and control unit 52 by wires 46. The intercom 54 contains a speaker 56 and a microphone 58 and is connected to an intercom control unit 60 (see FIG. 3) located inside the building and which also contains a speaker and a microphone. The intercom 54 and intercom control unit 60 allow persons inside the building to communicate with persons outside the door 24. The intercom 54 may also be used to broadcast a pre-recorded message upon activation of the motion detector 42. The broadcast message may welcome the person to the building, notify the person that the residents are not home, or may warn the person that a security system is protecting the building.

A video camera 62 is disposed on the hinge jamb 18 in a position to view the exterior side of the door 24. The camera 62 is connected with the sensor and control module 34 by wiring 46, and the camera is activated when movement is detected by the motion detector 42. The camera 62 may be connected to a video recorder (not shown) to create a record of all persons who enter or attempt to enter the building through a particular door 24. The camera 62 may also be monitored by persons within the building as is further described below.

In operation, the low-intensity light 36 is normally illuminated during all periods of darkness, as determined by the photocell 44, to assist persons trying to find the door opening. When the motion detector 42 is activated by movement within its field of view, such as the approach of a person, the sensor and control module 34 instructs the courtesy light 38 to switch on so as to provide brighter illumination in the area of the doorway for people seeking access to the building.

When a person carrying a remote control unit 52 desires to enter the building, he/she depresses a button on the remote control unit 52, thereby causing it to transmit its coded signal which is received by the radiant energy receiver 40. The sensor and control module 34 receives and reads the transmitted signal and, if it is valid, unlatches both the first and second electromechanical door latches 28,29 so that the door 24 may be pushed open. A second button may be provided on the remote control unit 52 to allow the user to activate the courtesy light 38 independently of the motion detector 42 if desired.

The door frame assembly 10, with all of the electrical components, is completely assembled at the factory so that it may be boxed and shipped in substantially the condition shown in FIG. 1. To install the door frame assembly 10 in a building, all that is required other than the normal procedures for installing a prior art pre-hung door is to connect the power supply wires 50 to the terminal block 48. The power supply wires 50 may be routed upwardly from a basement through holes in the floor immediately adjacent the door frame, or may be routed behind molding if desired.

By connecting the door frame assembly 10 to the building electrical wiring via power supply wires 50, the unit 52 may communicate with other electrical systems within the building via a "line carrier" system. Such a system for transmitting signals over the existing building wiring to control electrical lights 64 and appliances 66 connected thereto is marketed by the Stanley Works under the name Light-Maker™. When properly configured, such a line carrier system allows actuation of the remote control unit 52 to trigger the activation of any other light 64 or appliance 66 plugged into outlets of the building electrical system.

The entire system, including the intercom 54 and TV camera 62, may also be integrated into a computer-based home automation system. This allows various functions of the system to be monitored and/or controlled from one or more desk-top computers 68 within the home. For example, the user may use a computer 68 to program certain time periods during which the door latches 28,29 are to remain unlatched. Also, whenever a person or object approaches the door, as determined by the motion detector 42, an alert may be sounded on a computer 68, or video from the camera 62 may be displayed on a computer monitor. The system may also be programmed such that actuation of the remote control unit 52 switches on or off lights 64 or electrical appliances 66 inside the building.

A door unlatch switch 70 located in the interior of the building may also be connected to the door assembly 10 via the power supply wiring, thereby permitting a person inside the building to unlatch the door 24 when desired.

The motion detector 42 may also be integrated with an alarm system 72 via the building electrical system wiring or a computer network. Such integration allows lights or an audible alarm inside and/or outside the building to be activated when a person enters the field of view of the motion detector 42. Also, the alarm system 72 may be turned on or off by actuating a button on the remote control unit 52.

Although the present invention provides keyless access to the building, a conventional key (not shown) may still be used to unlatch the door 24. This allows a person to enter the building if they are not carrying a remote control unit 52 or if the entry system is not working properly.

In the door frame assembly 10 depicted in FIG. 1, the frame 12 is fabricated in the conventional manner from generally flat pieces of wood, metal or plastic. The wires 46 are routed along the outer surfaces of the head jamb 14 and latch jamb 20 so that the wires 46 will be disposed between the frame and the surrounding building walls when the frame is installed. It is also possible to practice the present invention with regard to a door frame formed of hollow or honeycomb jamb sections by routing the electrical wiring within the hollow interiors of the jambs.

Figure 4:
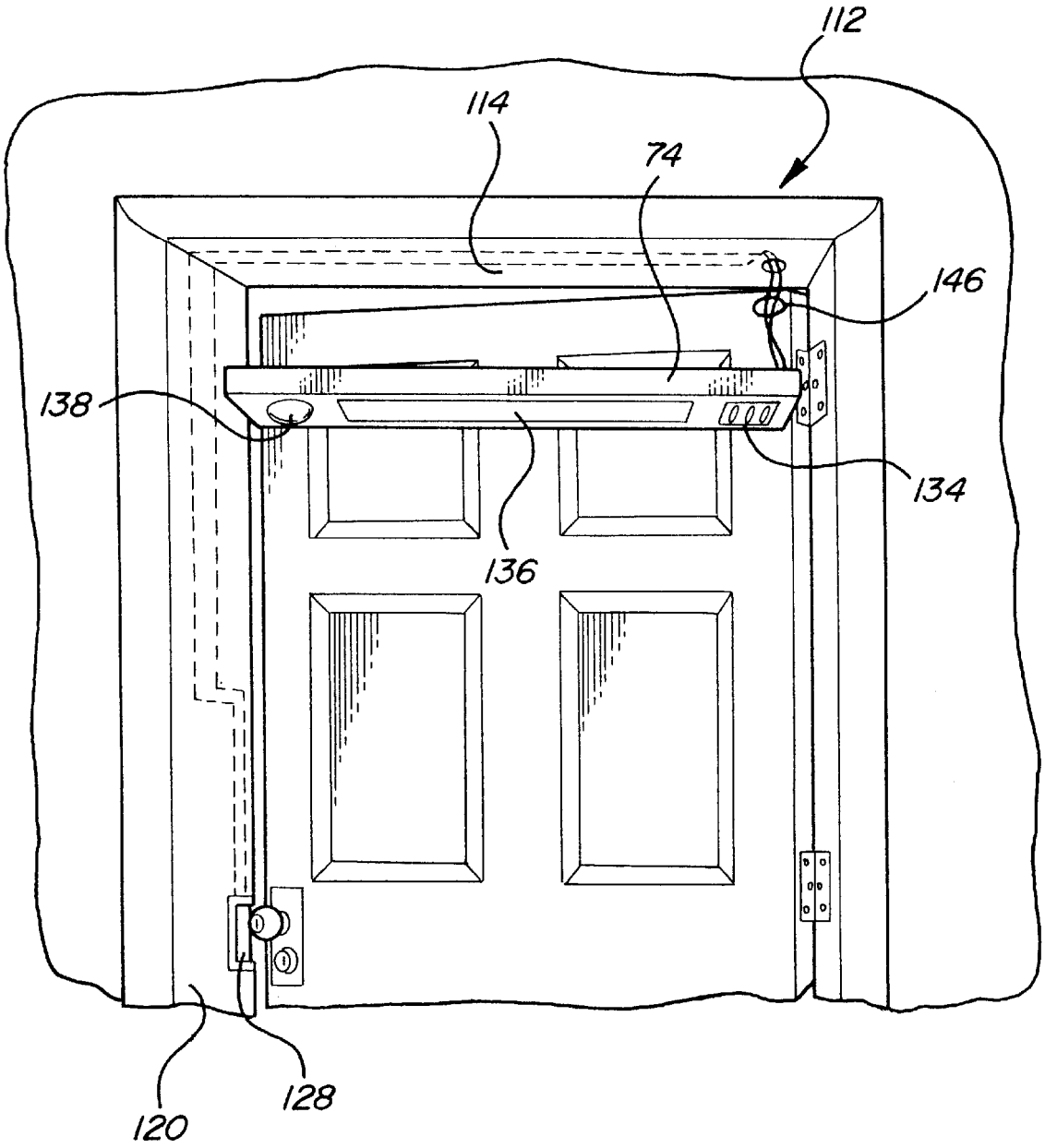
FIG. 4 is a partial view of an alternative embodiment of the invention.

In a second embodiment of the invention depicted in FIG. 4, a visor 74 is provided for mounting on the exterior side of a doorway beneath the head jamb 114 of a conventional door frame 112. The visor 74 is a housing which contains control and sensor module 134, a low-intensity light 136 and a higher intensity courtesy light 138, all of which are substantially similar to those components as described hereinabove. Electrical wires 146 extending from the visor 74 are routed through holes drilled through the head jamb 114 and downwardly along the latch jamb 120 to an electromechanical latch 128 on the door frame 112. This embodiment of the invention permits an entry control and security system to be retrofitted to an existing doorway with a minimum of amount of modification. The visor 74 fits substantially completely within the door frame 112 and when mounted as shown in FIG. 4 decreases the vertical clearance of the doorway by only a small amount.

Whereas a preferred embodiment of the invention has been illustrated and described in detail, it will be apparent that various changes may be made in the disclosed embodiment without departing from the scope or spirit of the invention.

The invention claimed is:

1. An entry control and security system for a pedestrian doorway comprising:

a pedestrian door frame;

a door attached to the frame for movement about a vertical hinge line between an open position and a closed position;

a light disposed on the door frame to illuminate an exterior side of the doorway when the door is in either the open position or the closed position;

a motion detector disposed on the door frame to detect motion on the exterior side of the doorway when the door is in either the open position or the closed position and electrically coupled with the light to activate the light upon detection of said motion;

a portable, wireless remote control unit manually actuatable by a user to transmit a radiant energy signal;

a radiant energy receiver disposed on the door frame for receiving the signal;

an electrically actuable latch disposed on the door frame operative to alternatively secure the door in the closed position with respect to the door frame and release the door so that it may be moved to the open position; and means for unlatching the latch to release the door in response to receipt of the signal by the receiver.

2. Apparatus according to claim 1 wherein the light is further activatable in response to receipt by the receiver of a second radiant energy signal transmitted by the wireless remote control unit.

3. Apparatus according to claim 1 further comprising a photocell disposed on the door frame and electrically coupled to the light to prevent activation of the light except during darkened periods.

4. Apparatus according to claim 3 further comprising a second light disposed on the door frame and electrically coupled with the photocell for continuous illumination during darkened periods.

5. Apparatus according to claim 1 further comprising means for connecting the system with a building electrical system.

6. Apparatus according to claim 1 wherein the latching means comprises an electro-mechanically actuatable strike plate.

7. Apparatus according to claim 1 wherein the receiver operates on a radio frequency.

8. Apparatus according to claim 1 wherein the receiver comprises means for identifying an identification code contained within the signal.

9. Apparatus according to claim 1 further comprising an intercom disposed on the door frame.

10. Apparatus according to claim 1 further comprising a video camera disposed on the door frame.

11. Apparatus according to claim 1 wherein the light, the motion detector and the radiant energy receiver are contained in a visor mountable to the door frame on the exterior side of the doorway.

12. An entry control and security unit for use with a pedestrian doorway including a door frame and a door attached to the frame for movement about a vertical hinge line between an open position and a closed position, the unit comprising:

a visor mountable to the door frame on an exterior side of the doorway;

a light disposed on the visor;

a motion detector disposed on the visor and connected with the light to activate the light upon detection of movement on the exterior side of the doorway;

a portable, wireless remote control unit manually actuatable by a user to transmit a radiant energy signal;

a radiant energy receiver disposed on the visor for receiving the signal;

an electrically actuable latch mounted on the door frame operable to alternatively secure the door in the closed position with respect to the door frame and releasing the door so that it may be moved to the open position; and means for unlatching the latching means to release the door in response to receipt of the radiant energy signal by the receiver.

13. The entry control and security unit according to claim 12 further including a portable, wireless remote control unit manually actuatable by a user to transmit the radiant energy signal.

14. Apparatus according to claim 12 further comprising means for connecting the system with a building electrical system.

15. Apparatus according to claim 12 wherein the latch comprises an electro-mechanically actuatable strike plate.

16. Apparatus according to claim 12 wherein the receiver operates on a radio frequency.

17. The entry control and security unit according to claim 12 wherein the means for unlatching the latching means comprises a microprocessor.

18. The entry control and security unit according to claim 17 wherein the microprocessor comprises means for identifying an identification code contained within the signal.

* * * * *